US006779376B2

(12) United States Patent
Linquist

(10) Patent No.: US 6,779,376 B2
(45) Date of Patent: Aug. 24, 2004

(54) FRAME STRAIGHTENING APPARATUS

(76) Inventor: Scott Allan Linquist, 18 Stephens Crescent, Whitecourt, Alberta (CA), T7S 1V9

( * ) Notice: Subject to any disclaimer, the term of this patent is extended or adjusted under 35 U.S.C. 154(b) by 19 days.

(21) Appl. No.: 10/236,978

(22) Filed: Sep. 9, 2002

(65) Prior Publication Data

US 2004/0045337 A1 Mar. 11, 2004

(51) Int. Cl.[7] ..... B21J 13/08

(52) U.S. Cl. ..... 72/457; 72/446; 72/447; 72/705

(58) Field of Search ..... 72/446, 447, 457, 72/458, 705

(56) References Cited

U.S. PATENT DOCUMENTS

| | | | | |
|---|---|---|---|---|
| 1,907,925 A | | 5/1933 | Wochner | |
| 2,597,234 A | | 5/1952 | Elam | |
| 2,836,219 A | | 5/1958 | Pertner | |
| 3,452,575 A | | 7/1969 | Williams et al. | |
| 3,457,767 A | | 7/1969 | Surber | |
| 3,518,867 A | | 7/1970 | Rouis | |
| 3,583,203 A | | 6/1971 | Williams et al. | |
| 3,590,623 A | * | 7/1971 | Hunnicutt et al. | 72/302 |
| 3,626,747 A | | 12/1971 | Rouis | |
| 3,712,108 A | * | 1/1973 | Hunnicutt | 72/446 |
| 3,789,652 A | * | 2/1974 | Buske | 72/457 |
| 4,055,061 A | | 10/1977 | Bayorgeon et al. | |
| 4,088,006 A | * | 5/1978 | Patten | 72/457 |
| 4,238,951 A | * | 12/1980 | Grainger et al. | 72/457 |
| 4,510,790 A | * | 4/1985 | Hare | 72/457 |
| 4,781,045 A | * | 11/1988 | Celette | 72/31.02 |
| 4,823,589 A | | 4/1989 | Maxwell, Jr. et al. | |
| 4,930,333 A | | 6/1990 | Marbury | |
| 4,941,343 A | | 7/1990 | Stancato | |
| 4,955,224 A | | 9/1990 | Field | |
| 5,257,526 A | | 11/1993 | Teixeria | |
| 5,509,289 A | | 4/1996 | Narragon | |

* cited by examiner

*Primary Examiner*—Ed Tolan
(74) *Attorney, Agent, or Firm*—Terrence N. Kuharchuk; Smart & Biggar

(57) ABSTRACT

A vehicle frame straightening apparatus includes a substantially upright post adapted to engage a rail mounted transversely to a series of rails fixed to the floor on which the vehicle rests, and adapted to apply pressure between the floor and outward on a deformity in the frame from under the vehicle by a ram engaged therebetween. A holding assembly for holding the vehicle in position engages the vehicle frame from the outside and engages a second rail mounted transversely to the rails fixed to the floor. Preferably the post includes a substantially upright lower portion and an upper portion pivotally attached thereto in order to extend its height, wherein the lower portion does not exceed the ground clearance of the vehicle. Thus, the post may be placed into position against the deformity from beside the vehicle without requiring an increase in the vehicle's ground clearance.

34 Claims, 9 Drawing Sheets

FRAME STRAIGHTENING APPARATUS

FIELD OF THE INVENTION

This invention relates to vehicular body work systems and in particular to an improved vehicle frame straightening apparatus.

BACKGROUND OF THE INVENTION

Since the dawn of the automotive age, there has been a need for automotive bodywork. Originally, frame damage was minimal and bodywork was restricted to the repair of dents in the vehicle using hammers and mallets. On occasion, frame damage was sustained. Because of the relatively light weight of vehicles and the slow speeds at which they operated, such damage was usually slight and no corrective action was necessary.

As the speed of automotive travel and as the weight of vehicle bodies increased, so did the frequency and severity of frame damage. The complexity of auto body repair increased correspondingly.

At present there are two basic approaches to body work, namely frame pulling and frame pushing. The former approach involves the attachment of chains to the vehicle frame and the application of tension to pull the frame into a desired shape. Frame pushing involves the positioning of posts at particular points along the frame and the application of pressure to push the frame into the desired shape.

There is much to commend the frame pulling approach. The apparatus is often lighter and cheaper. Moreover, most vehicular collisions result in the frame being bent inward, so that a frame pulling apparatus may be conveniently set up outside the frame, to pull the frame outward.

However, notwithstanding the foregoing, it is generally recognized that the frame pushing approach is superiour to the frame pulling approach. This is because of the limited number of points on a vehicle frame to which the chains of a frame pulling apparatus may be attached. Furthermore, the use of chains to apply tension generally introduces a downward force component in addition to the desired lateral force component, which must be taken into account. Accordingly, the quality of the repair using such an apparatus is generally sub-optimal.

On the other hand, frame pushing posts need not be fastened to the frame, but merely moved into place. Moreover, frame pushing does not introduce any vertical force component.

The drawback to the frame pushing approach has been that the apparatus is generally larger, heavier and bulkier. Solid posts are required, as compared to chains. This is compounded by the fact that the apparatus must generally be installed inside the frame in order to push the inward-facing deformities outward.

Therefore, frame pushing apparata have required the vehicle under repair to be positioned above ground, in order to permit the solid posts, which exceed the ground clearance height for the vehicle, to be inserted from below the vehicle.

Furthermore, set-up times for frame pushing machines are typically much longer than those for frame pulling machines, although these too may eclipse the actual time required to conduct the actual repair.

Thus, in U.S. Pat. No. 1,907,925 entitled Automobile Frame Straightening Machine issued to Wochner on May 9, 1933, there is disclosed a frame pushing apparatus comprising a pair of elevated longitudinal rails adapted to accept the wheels of the vehicle to be repaired. A pair of ramped rails extends from ground level to the elevated rails to permit the vehicle to be wheeled onto the elevated rails. Transverse rails extend below the elevated rails and solid one-piece pushing posts are attached thereon to extend above the surface of the elevated rails and engage the frame body, taking advantage of the increased ground clearance of the vehicle while on the elevated rails.

Because of the different wheel bases of vehicles, the separation between the elevated rails in the Wochner apparatus must be adjusted for every vehicle. In effect, the apparatus must be repositioned and rebuilt for every repair operation. Further, the wheeling of the vehicle up the ramps and onto the elevated rails is somewhat precarious. As a result, the set-up time required may be considerable.

In U.S. Pat. No. 2,597,234 entitled Frame Straightening Device and issued May 20, 1952 to Elam, there is disclosed a portable device consisting of a single rail from which extends a solid one-piece pushing rod and a holding rod. The Elam device avoids the problem of ground clearance because it is small enough to be inserted under the vehicle while on its side and stood upright once in position. Indeed, there is no requirement that the Elam device be stood upright on the ground, much less secured to it.

Rather, the Elam device requires that the rail be positioned so that the holding rod engages a portion of the frame that is not susceptible to bending and acts as a bracing point for the pushing rod as it applies pressure to the frame portion to be repaired.

Because of its portable nature, the Elam device must necessarily be completely repositioned for every repair activity, even when, as is often the case, multiple repairs must be effected on the same frame. Accordingly, the set-up time for the Elam device may also be considerable.

More importantly, the Elam device is necessarily restricted in the nature of repairs that may be effected because of the need to locate a bracing point elsewhere on the frame. In this regard, the Elam apparatus suffers from the deficiencies noted above in respect to frame-pulling apparata.

In U.S. Pat. No. 5,257,526 entitled Automotive Frame Straightening Apparatus and issued Nov. 2, 1993 to Teixeria, there is disclosed an apparatus comprising a plurality of solid towers in slidable engagement along three sides of a grooved rectangular frame. The towers provide both pushing/holding elements and pulling elements, but the vehicle is loaded onto the frame along the fourth side and positioned inside all of the towers. The pushing/holding elements thus only apply pressure from the outside of the frame inward. In essence, then, the Teixeria device acts as a frame pulling apparatus. Moreover, because the solid towers are mounted outside the vehicle frame, there is no concern about ground clearance.

SUMMARY OF THE INVENTION

Accordingly, it is desirable to provide an improved vehicle frame straightening apparatus.

It is further desirable to provide an improved apparatus that provides the advantages of the frame pushing approaches without the disadvantages of slow and difficult set-up previously associated with such approaches.

It is still further desirable to provide an improved apparatus that permits frame pushing repair from the interior of the vehicle frame without concern for ground clearance.

The present invention accomplishes these aims by providing a frame straightening apparatus using vertical posts positioned under the vehicle to push outward to straighten deformities in the frame. The apparatus is lightweight, strong and easily configurable from beside the vehicle under repair, without requiring increased ground clearance. The apparatus comprises a pair of floor rails bolted to, embedded within or forming part of the floor of the repair facility. The top of each floor rail has a partially closed channel into which a series of bolts can be inserted and slid longitudinally along the rail. The bolts can be used to quickly fasten and adjust a transverse U-shaped pushing rail and one or more transverse holding rails. The pushing rail has a series of bores along each leg, to which a U-shaped pivot base may be attached using pins. The pivot base is short enough to clear the undercarriage of a vehicle under repair positioned over the floor rails. A pushing post may then be positioned into place and quickly fastened into place at the top of the pivot base using pins. The pushing post pivots about the pivot base and, under the force of a ram assembly attached at the other end to the pushing rail, can apply pushing pressure on the frame of the vehicle under repair. Each holding rail permits a sliding post to slide along its length. One of the sliding posts may conveniently be short enough to clear the undercarriage of the vehicle under repair. A holding post may be positioned into place and quickly fastened into place at the top of the sliding post using pins. The holding post grips the exterior of the vehicle frame and is held in position by a chain attached at its other end to the holding rail. Diamond repairs may be effected using a set of diamond rails comparable to and abutting the floor rails in a transverse direction. Minor downward frame pulling repairs may be effected by the use of a pulley assembly attached to the pushing rail and a chain assembly. The apparatus may be conveniently mounted onto the bed of a towed platform to permit remote repairs.

According to a first broad aspect of an embodiment of the present invention there is disclosed a vehicle frame straightening apparatus comprising a substantially upright post for engagement with the floor on which the vehicle rests, and adapted to apply pressure between the floor and outward on a deformity in the frame from under the vehicle, whereby the post may be placed into position against the deformity from beside the vehicle without requiring an increase in the vehicle's ground clearance.

According to a second broad aspect of an embodiment of the present invention there is disclosed a vehicle frame straightening apparatus comprising a substantially upright post adapted to engage a rail to be mounted transversely to a series of rails fixed to the floor on which the vehicle rests, and adapted to apply pressure between the floor and outward on a deformity in the frame from under the vehicle by a ram engaged there between, wherein the vehicle may be held in position by at least one holding assembly adapted to engage the vehicle frame from the outside and to engage to a second rail to be mounted transversely to the rails fixed to the floor, and wherein the post comprises a substantially upright lower portion and an upper portion adapted to be pivotally attached thereto in order to extend its height and wherein the lower portion does not exceed the ground clearance of the vehicle, whereby the post may be placed into position against the deformity from beside the vehicle, without requiring an increase in the vehicle's ground clearance.

BRIEF DESCRIPTION OF THE DRAWINGS

The embodiments of the present invention will now be described by reference to the following figures, in which identical reference numbers in different figures indicate identical elements and in which.

DETAILED DESCRIPTION OF THE PREFERRED EMBODIMENTS

Figure 1:
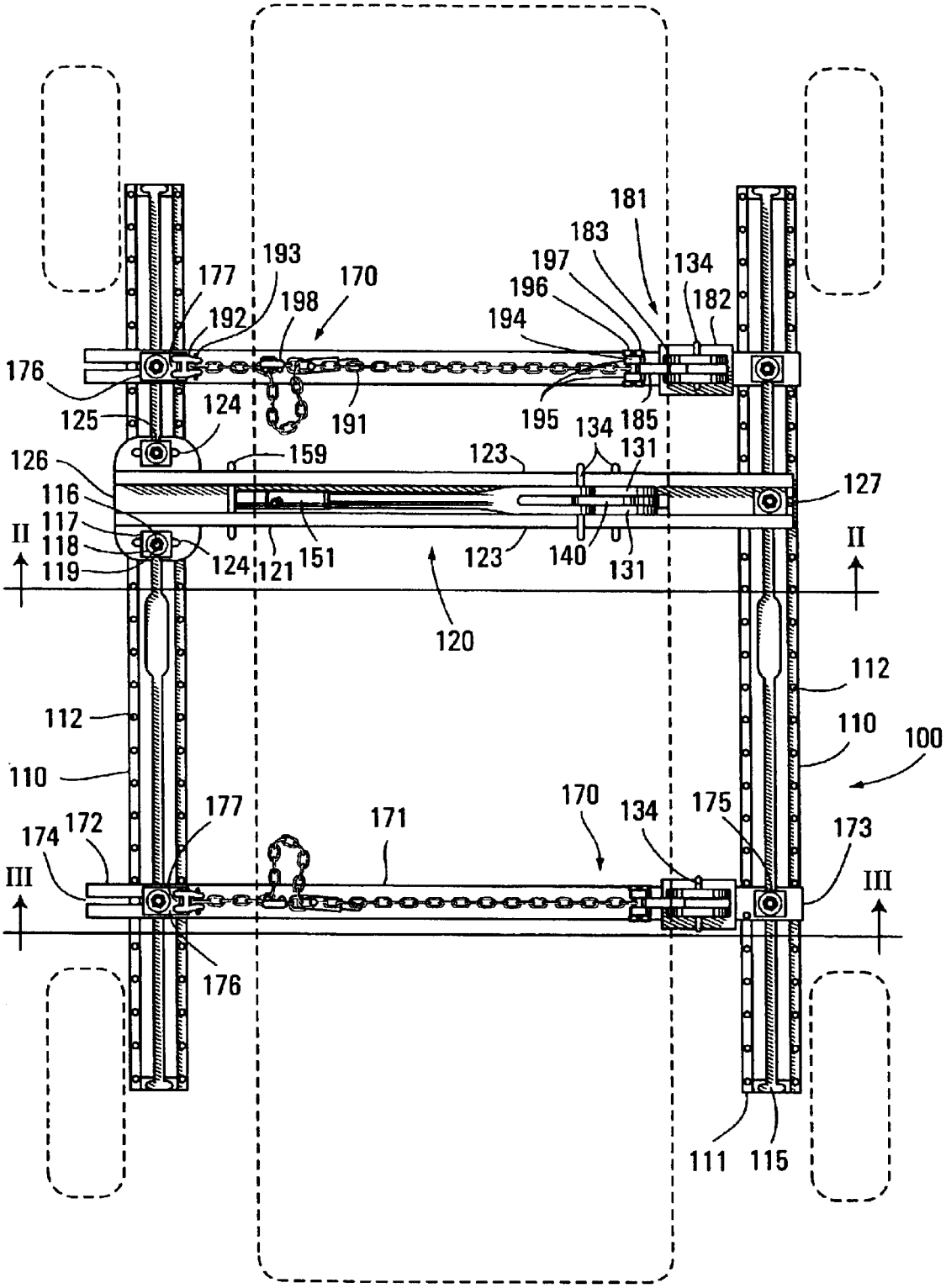
FIG. 1 is a plan view of an embodiment of the present invention.

Referring now to FIG. 1, there is shown a plan view of a first embodiment of the present invention. The apparatus, shown generally at 100, comprises a pair of longitudinal floor rails 110, a transverse pushing assembly 120, and two transverse holding assemblies 170.

The floor rails 110 extend parallel to each other in a longitudinal direction. The floor rails 110 comprise a flat portion 111 containing a series of bores 112 through which the floor rails 110 may be bolted to the floor 101 of the repair facility.

A narrower partially closed channel 115 is superimposed over the flat portion 111. The opening in the channel 115 extends upward away from the flat portion 111. At one or more points intermediate to each extremity of the floor rail 110 there is a larger opening in the channel 115. The floor rails 110 may be cast or extruded out of aluminum. Alternatively, the floor rails 110 may be composed out of separate pieces of similar material welded or otherwise fastened together.

Aluminum provides a desirable combination of relatively light weight and high tensile strength, with little or no bending. However, those having ordinary skill in this art will recognize that there are a variety of other suitable high strength materials that may be substituted therefor.

The pushing assembly 120 comprises a pushing rail 121, a pivot base 130, a pushing post 140, a swivel plate 146, a clevis 139, a ram assembly 150, a pushing fork 160, and pushing extensions 166.

The pushing rail 121 is generally U-shaped, with a series of bores 122 extending through each of the pushing rail legs 123 near their extremities. The series of bores 122 are generally uniformly spaced apart and correspond as between legs 123. The width of the pushing rail 121 is sufficient to accommodate the ram assembly 150, and its height is sufficient to accommodate the ram assembly 150 when positioned proximate to the pivot base 130. The pushing rail 121 may be cast or extruded out of aluminum. Alternatively, it may be composed out of separate pieces of similar material welded or otherwise fastened together.

One end (the notch end) 127 of the pushing rail 121 terminates in a notch having a width generally corresponding to the diameter of the bolt 116. The notch extends between the two pushing rail legs 123.

The pushing rail 121 may be fixed at the notch end 127 to one of the floor rails 110 by fasteners, such as by a bolt assembly comprising a bolt 116, a plate washer 117, a thin washer 118 and a nut 119.

The bolts 116 have large rectangular heads, one dimension of which generally corresponds to the size of the channel 115 of the floor rail.

The wider opening in the channel 115 of the floor rail 110 permits the easy insertion of the bolt 116, head down within the floor rail 110. The bolt 116 protrudes out of the floor rail channel 115 and is easily slideable along it. The pushing rail 121 may be mounted on the top of the floor rail channel 115, such that the notch surrounds the bolt. Once in position, the channel 125 is effectively closed off by the addition of a plate washer 117 over the bolt 116. A thin washer 118 and nut 119 are applied and when tightened, securely fix the notch end 127 of the pushing rail 121 to a floor rail 110.

At the other end (the flange end) 126 of the pushing rail 121, a pair of horizontal flanges 124 extend away from the flange end of the pushing rail 121. Each of the horizontal flanges 124 is partially closed. The opening 125 in the flange 124 extends away from the pushing rail 121. Once the notch end 127 is attached to the floor rail 110, the flange end 126 may be attached to the remaining floor rail 110, through the opening 125 in each of the flanges 124.

When the three bolt assemblies 116–119 are slightly loosened, the pushing rail 121 may be slideably moved along the length of the floor rail in relatively parallel position.

The combination of the fixed floor rails 110 and the three loosened bolt assemblies 116–119 permits easy and quick adjustment of the position of the pushing rail 121 whenever needed. The bolt assemblies 116–119 need only be slightly loosened and the pushing rail 121 slid along the floor rails 110 to the desired position. When this position has been reached, the pushing rail 121 may be quickly fixed in place by tightening the bolt assemblies 116–119, typically using air driven wrenches as are prevalent in automotive repair facilities.

The pivot base 130 is a U-shaped post adapted to fit within the legs 123 of the pushing rail 121. The pivot base 130 may be cast or extruded out of aluminum. Alternatively, it may be composed out of separate pieces of similar material welded or otherwise fastened together.

The legs 131 of the pivot base 130 are longer than the legs 123 of the pushing rail 121. However, as may be better seen in FIG. 2, they remain short enough to clear the bottom of a vehicle positioned on the floor 101 above it, even when mounted between the legs 123 of the pushing rail 121 mounted on the floor rails 110. In the present embodiment, a height of 12 inches has been found to be satisfactory.

Each pivot base leg 131 has a series of horizontal bores 132 near the base 133 of the pivot base 130. The size of the bores and their separation correspond to that of the bores 122 on the pushing rail legs 123. Thus, pins 134 may be inserted through a bore 122 on one leg 123 of the pushing rail 121, through the bores 132 on each pivot base leg 131 and through the corresponding bore 122 on the other leg 123 of the pushing rail 121. When two pins 134 are passed through pairs of bores 132 in the pivot base 130, the pivot base 130 is fixed in position along the pushing rail 121.

The use of pins 134 further assists in the easy set-up of the embodiment of the present invention. The pins 134 are cylindrical and have no heads or threads. Rather, the diameter of the pins 134 generally corresponds to the size of the bores 122, 132. In combination with the length of the pins 134, which is several inches longer than the width of the pivot rail 121, this serves to ensure that the pins 134 will not be accidentally displaced. optionally, a cap may transversely surround the pin 134 at an intermediate point to provide a stopping surface to prevent over-insertion of the pin 134, together with a convenient handle with which to withdraw it.

Each of the legs 131 of the pivot base 130 also contains a vertical series of bores 135 extending from the pair of bores 132 and along the length of the legs 131. As a convenience, standard sizes of bores and pins are used throughout the embodiment of the present invention. A bore diameter of ⅞" and capable of accepting a pin 134 that is 13⁄16" in diameter has been found to be satisfactory.

The pushing post 140 is relatively planar, having a thickness that generally corresponds to the separation between the legs 131 of the pivot base 130, into which it is inserted. The pushing post 140 may be constructed out of steel or cast iron, or other very high strength material. A pushing post 140 height of 18 inches is suitable for the present embodiment.

At one end (the pivoting end) 141 of the pushing post 140, a first series of bores 142 extend partially along the length of the pushing post 140. The spacing of the pushing post bores 142 need not be comparable to that of the pivot base 130, because only one pin 134 will pass through the two series of bores 135, 142. Accordingly, the pushing post 135 is able to pivot about the pin 134. The pivot point may be adjusted by judicious choice of which pair of bores 135 in the pivot base 130 and which bore 142 in the pushing post 140 are chosen.

Figure 2:
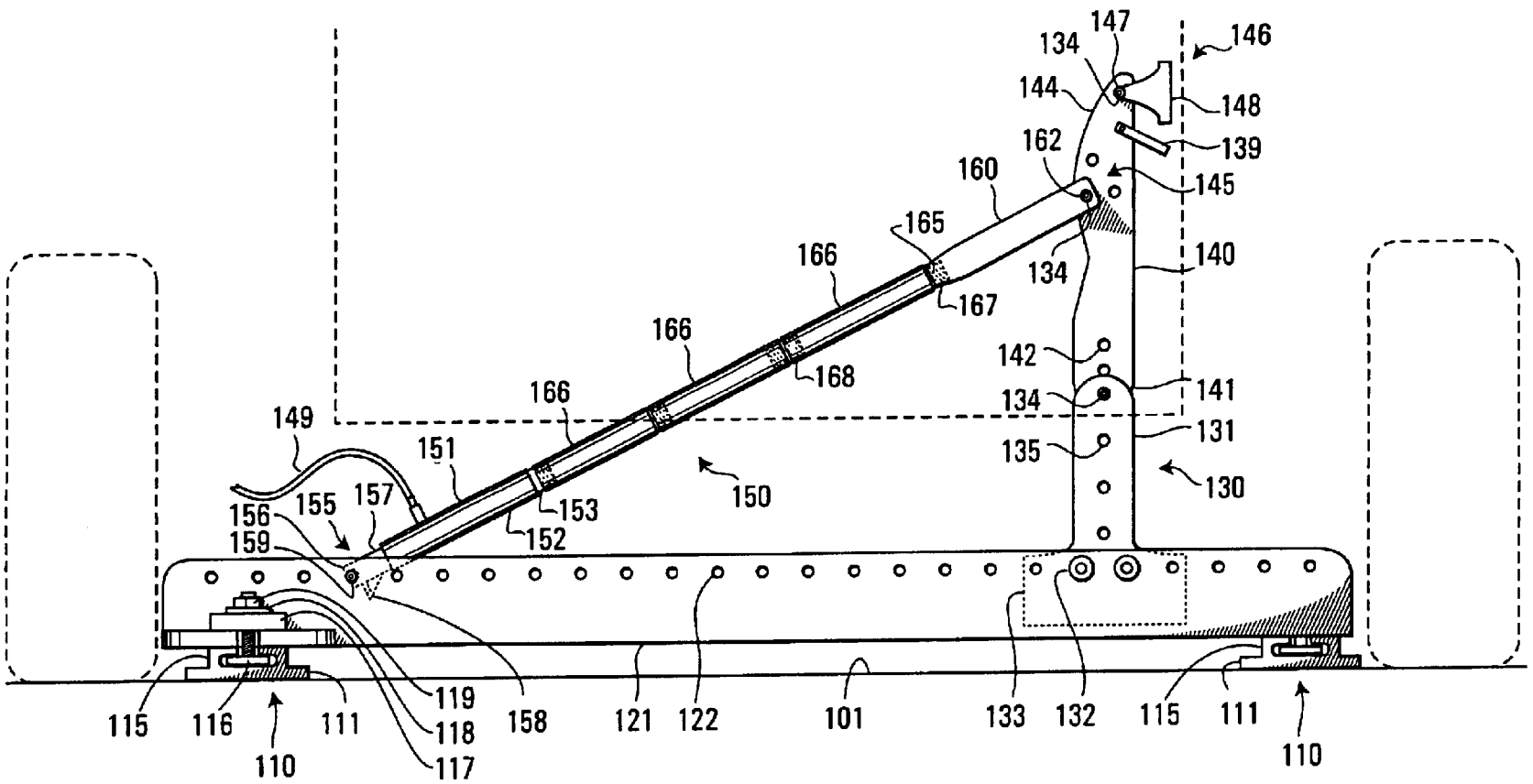
FIG. 2 is a sectional view of the embodiment of FIG. 1 taken along the section II—II with background detail deleted for clarity.

At the other end (the shaped end) 144 of the pushing post 140, there is a second series of bores 145. The shape of the shaped end 144 and the positioning of the second series of bores 145 may be chosen to permit such subtleties in pushing pressure as may be necessary for the task. The shape and bore positions shown in FIG. 2 are eminently suitable for the purpose, but it will be understood by those having ordinary skill in this art that other shapes and/or bore positions may be equally satisfactory and will not depart from the spirit and scope of the present invention.

The swivel plate 146 is roughly polyhedral in shape. It too may be constructed out of steel or cast iron, or other very high strength material. The base 148 of the swivel plate 146 is flat. The other end of the swivel plate 146 is forked and has a bore 147 passing therethrough. Thus, the swivel plate 146 may be pivotally attached by a pin 134 to the shaped end 144 of the pushing post 140 to provide a wide and flat pushing surface 148.

The clevis 139 is U-shaped having bores at the extremities of its legs, by which it can be bolted to the pushing post 140.

The ram assembly 150 comprises a ram 151, a pivoting head 155 and a pivot fastener 159. The ram 151 may be a 10 ton hydraulic ram that is well known in the art, driven by a hydraulic source (not shown) through a hose 149 interconnecting the two.

The ram 151 comprises an outer cylindrical sleeve 152 and an inner cylindrical extension element 153 in slidable engagement therewith. The outer sleeve 152 is externally threaded at one end and open at the other. At a point intermediate between the two ends, however, the outer sleeve 152 is completely closed. A hose connection is positioned proximate to the closed point but on the other side from the threaded end. The inner cylindrical extension element 153 is housed in the unthreaded side of the outer sleeve 152, and extends slightly beyond it. When hydraulic fluid is introduced in through the hose connection, from a hydraulic source (not shown)via the hose 149, the hydraulic pressure forces the inner extension to protrude farther out of the ram 151 in response.

The pivoting head 155 is generally cylindrical in shape having a closed end 156 and open end 157. The open end 157 is internally threaded and adapted to engage with the external threads on the ram 151. The closed end 156 has a scalloped contour and bears a protrusion 158 along one side, as shown in dotted outline in FIG. 2. The pivot fastener 159 is adapted to pass through a pair of bores 122 in the pushing rail 121. The pivot fastener 159 comprises a bolt. Alternatively, a pin 134 may be substituted.

The scalloped contour 156 of the pivoting head 155 is adapted to partially surround the pivot fastener 159 and permits the ram assembly 150 to pivot about it. The protrusion 158 passes between the pushing rail legs 123 and below the pivot fastener 159 so as to restrict the pivoting motion in one direction.

The pushing fork 160 is U-shaped. The separation between the legs generally corresponds to the thickness of the pushing post 140. The legs of the pushing fork 160 each have a bore 162 passing therethrough proximate to their end. Thus, a pin 134 may be passed through the pushing fork bores 162 and through one of the bores 145 in the pushing post 140, to permit the pushing post 140 to pivot about the pin 134. The closed end of the pushing fork 160 has, in the surface pointing away from the legs, an internal bore 165. The internal bore of the pushing fork 160 is adapted to engage the exposed portion of the inner cylindrical extension element 153 of the ram 151.

The pushing extensions 166 are cylindrical extension pieces having an external protrusion 167 at one end and an internal bore 168 at the other. The protrusions 167 are adapted to engage the internal bore 165 of the pushing fork 160 and the internal bore 168 of other pushing extensions 166.

A number of pushing extensions 166 of varying lengths, such as 4 inches, 8 inches and 16 inches may be joined together. The pushing fork 160 and the pushing extensions 166 may be composed of steel.

The holding assembly 170 comprises a holding rail 171, a holding post assembly 180 and a chain assembly 190.

The holding rail 171 is a flat elongate bar having approximately the same length as the pushing rail 121. It may be cast or extruded out of aluminum. Alternatively, it may be composed out of separate pieces of similar material welded or otherwise fastened together.

At one end (the parallel end) 172, the holding rail 171 terminates in a notch 174 having a longer dimension parallel to the axis of the holding rail 171. The notch has a width generally corresponding to the width of the bolt 116. At the other end (the transverse end) 173, a notch 175 of substantially the same dimension extends transverse to the axis of the holding rail 171 and proximate to its end.

Two bolt assemblies comprising components similar to the bolt assembly 116–119 used to secure the pushing rail 121 to the floor rail 110 may be used to attach the holding rail 171 to the floor rails 110 at each end. The only difference is in the angled plate washer 176. Whereas the plate washer 117 used to secure the pushing rail 121 was flat, a portion of the angled plate washer 176 is angled so as to protrude upward. A slot 177 extends through the angled portion of the angled plate washer 176. Such angled plate washers 176 will be used as part of the bolt assembly used to secure at least one end of the holding rail 171 to the floor rail 110.

A bolt 116 is inserted into the channel 115 of each floor rail 110 with the head protruding from the opening in the channel 115. The holding rail 171 is positioned over the bolt 116 in one floor rail 110 such that the straight notch 174 surrounds the bolt 116 and the plate washer 117 (or angled plate washer 176), the washer 118 and nut 119 are attached in a loose fit. The bolt 116 in the remaining floor rail 110 may be inserted into the open end of the open bore 175 by suitable pivoting of the holding rail 171. Once in position, the plate washer 117 (or angled plate washer 176), the washer 118 and nut 119 are also attached in a loose fit. At this point, the holding rail 171 may be returned to a position normal to each of the floor rails 110 and moved to the desired position, whereupon the bolt assemblies may be tightened, typically using air-driven wrenches.

The holding post assembly 180 comprises a sliding post 181 and a holding post 185. The sliding post 181 comprises a hollow rectangular channel 182 and two vertical holding bases 183 protruding from a flat outer surface of the channel in a U-shaped configuration. The sliding post 181 may be composed of separate pieces of cast or extruded aluminum welded or otherwise fastened together.

The rectangular channel 182 has interior dimensions that slidably surround and engage the holding rail 171. Typically the rectangular channel 182 is slid onto the holding rail 171, with the vertical holding bases 183 extending upward, before the holding rail 171 is attached at both ends to the floor rail 110.

Figure 3:
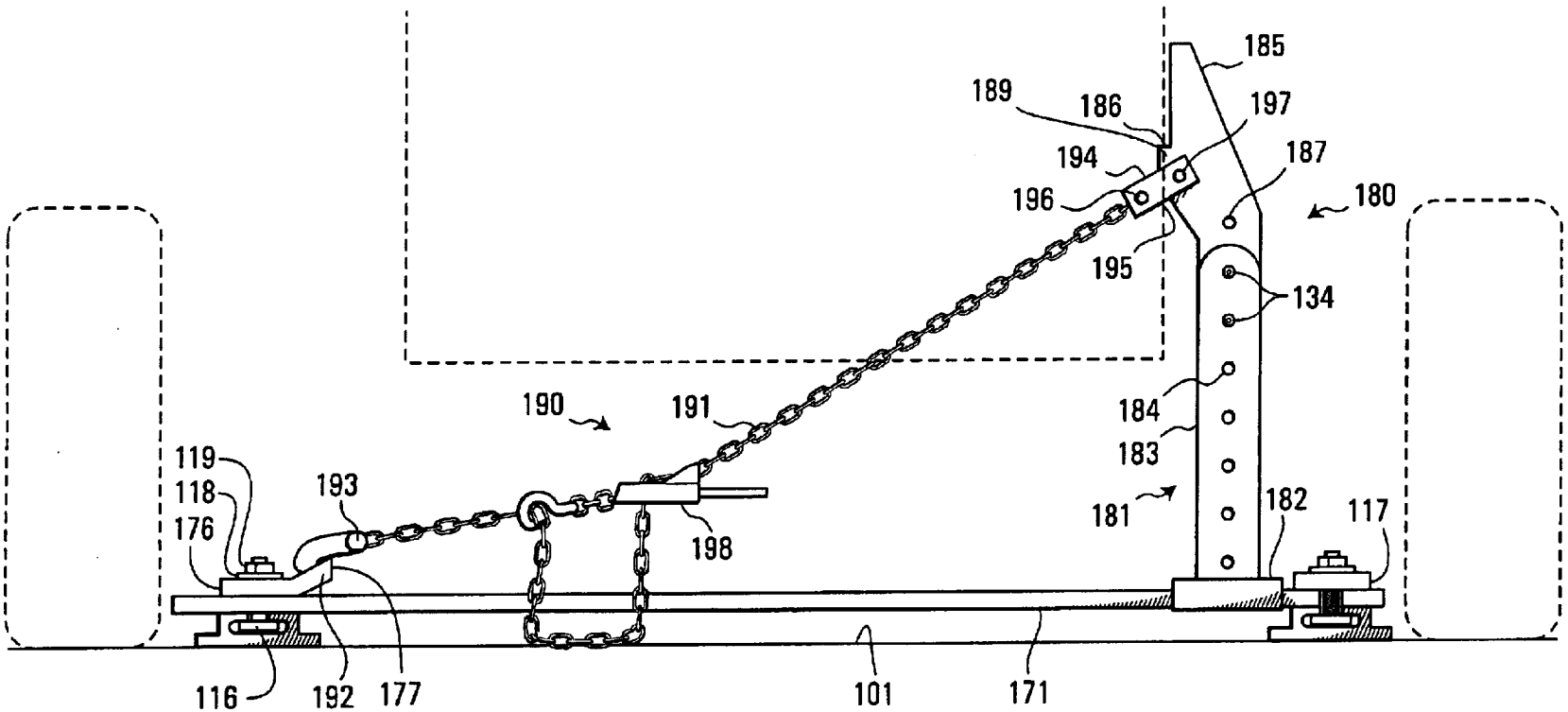
FIG. 3 is a sectional view of the embodiment of FIG. 1 taken along the section III—III with background detail deleted for clarity.
Figure 4A:
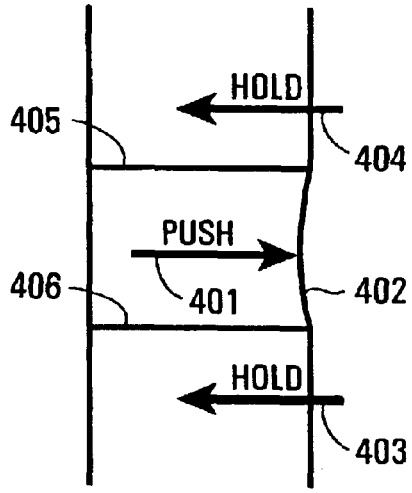
FIGS. 4*a* through 4*d* are diagrammatic representations of the forces applied in various configurations of the embodiment of FIG. 1.
Figure 4B:
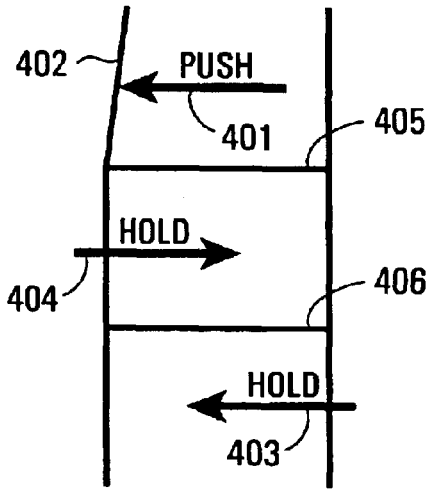
Figure 4C:
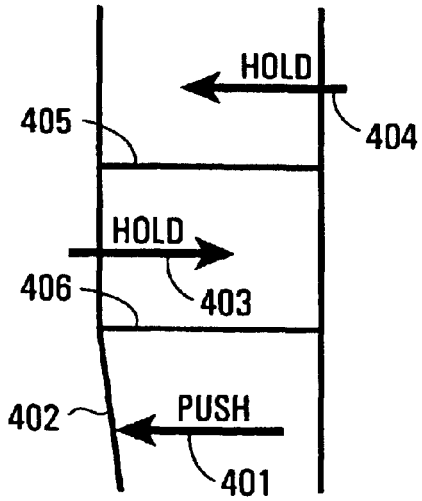
Figure 4D:
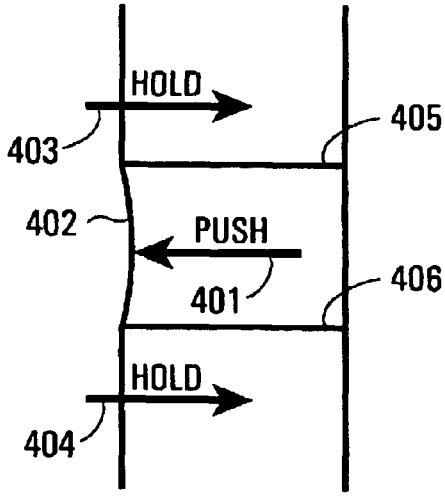

As may be better seen in FIG. 3, the vertical holding bases 183 have a series of bores 184 extending vertically along their length, in a generally uniformly spaced pattern. In the present embodiment, the vertical holding base 183 for each of the sliding posts 181 are of different heights but are otherwise substantially identical.

The shorter sliding post 181 has a height of 12 inches, which permits it to be positioned on a holding rail 171 mounted on the floor rails 110, without coming into contact with the bottom of most vehicles, when positioned on the floor.

The taller sliding post 181 has a height of 18 inches, which will not typically fit with clearance under a vehicle.

The holding post 185 is planar, and may be cast or extruded out of aluminum. The shape of the holding post 185 is polygonal. A ledge 186 is defined on one side of the holding post 185. A series of bores 187 pass through the planar surface of the holding post 185. The shape and bore positions shown in FIG. 3 are eminently suitable, but it will be understood by those having ordinary skill in this art that other shapes and/or bore positions may be equally satisfactory and will not depart from the spirit and scope of the present invention.

The holding post 185 may have a thickness that generally corresponds to the separation between the vertical holding bases 183, between which it is inserted. The holding post 185 may be fixed in position by inserting a pair of pins 134 between corresponding bores 184 in the vertical holding bases 183 and bores 187 in the holding post 185.

The chain assembly 190 comprises a chain 191, a bottom clip 192, a top clip 194 and a chain tensioner 198. The chain 191 may be of standard steel or iron ⅜" chain, grade 8, having a rated strength of 25,000 pounds. The bottom clip 192 is a curved clip adapted to attach to the chain 191 at one end by a bolt assembly 193 and to engage the slot 177 of the plate washer 176 securing one end of the holding rail 171 to the corresponding floor rail 110. Thus, the chain 191 may be fixed to the holding rail 171 at one end.

The top clip 194 comprises two pieces of aluminum 195, each having bores at either end, through which two bolt assemblies 196, 197 may pass. One bolt assembly 196 secures the other end of the chain 191 between the pieces of aluminum 195. The other bolt assembly 197 secures the holding post 185, at a point 189 proximate to and below the ledge 186, between the pieces of aluminum 195. Thus, the chain 191 may be fixed to the holding post 185 at the other end.

The chain tensioner 198 engages the chain 191 at an intermediate point and may be activated to take up any slack in the chain 191 in a quick and easy operation. When the chain tensioner 198 is released, the chain 191 tension is reduced, permitting the chain to be disconnected and reconnected at either end.

In operation, the vehicle to be repaired is usually driven or positioned such that its wheels lie outside the floor rails 110, which have been fixed to the floor 101 using bolts through the bores 112, approximately 6 feet apart. Nevertheless, those having ordinary skill in this art will readily recognize that the vehicle may be positioned, relative to the apparatus shown in this embodiment, in any orientation that may prove to be convenient and effective.

The apparatus shown in this embodiment of the present invention is especially suitable for repairs of full frame vehicle bodies such as found on trucks. In such cases, the frame rarely exceeds four feet in width, which can be easily accommodated by the apparatus with a floor rail separation of six feet. The apparatus shown is also suitable for repairs of the frame portion of unibody frames.

Because the wheels lie beside the floor rails 110, the bolts 116 may be easily slid into the channel 115 of the floor rail 110 at one of the wider openings and advanced along the track formed by the opening in the channel 115 until they reach the desired position. At this point, the pushing rail 121 and holding rails 171 may be moved into position from the side of the vehicle, as previously described.

As can be seen in FIG. 4, the pushing rail 121 is positioned 401 directly opposite the frame position where the repair is to be effected by a pushing operation 402. Force will be applied from the interior of the frame outward at this point. Generally, the pushing rail 121 is oriented such that the flange end 126 is proximate to the ram assembly 150, and the notch end 127 is proximate to the pivot base 130 and thus to the frame position where the repair is to be effected.

The holding rails 171 are positioned 403, 404 directly opposite the frame position where a corresponding inward force is to be applied to the frame to hold the frame into position in order to effect the repair. Generally, the objective is to separate the pushing rail 121 from the holding rails 171 by a cross member 405, 406 in the vehicle frame.

If only one angled plate washer 176 is used per holding rail 171, it should be positioned at the end of the holding rail 171 farthest away from where the holding force 403, 404 is to be applied.

Prior to attaching the holding rails 171, a sliding post 181 must be slid over each holding rail 171. Generally, the sliding post 181 is left to the outside of the frame. Nevertheless, the height of the sliding post 181 is small enough that there would generally be clearance between its top and the bottom of the vehicle, so that the sliding post 181 would remain free to slide along the holding rail 171 and under the vehicle.

Generally, the pushing rail 121 is fixed into position first, while the holding rails 171 are left free to slide to permit final adjustment once the pushing post 140 is properly positioned.

Once the pushing rail 121 has been fixed in position, the pivot base 130 may be installed by positioning it between the pushing rail legs 113 in a suitable position. The pivot base 130 is quickly fixed in place by sliding a pair of pins 134 between corresponding bores 122 in the pushing rail legs 123 and bores 132 in the pivot base 130.

The height of the pivot base 130 is small enough that there would generally be clearance between the top of the pivot base 130 and the bottom of the vehicle, so that fine adjustments to the position may be made without catching the bottom of the vehicle.

The pushing post 140 is thereupon quickly attached to the pivot base by positioning it between the pivot base legs 131 and passing a single pin 134 between corresponding bores 135 in the pivot base legs 131 and a bore 145 in the pushing post 140. The U-shape of the pivot base 130 permits the pushing post 140 to be raised into position from below the vehicle, generally without requiring the vehicle to be raised off the ground to increase ground clearance. On some lower end or 2 wheel drive pickups having reduced ground clearance, different (lower) heights for the pushing post 140 and pivot base 130 may be required to avoid having to temporarily raise the vehicle off the ground to permit adjustment of these elements.

Because only a single pin 134 is used, the pushing post 140 may pivot downward toward the pushing rail 121 so as not to catch on the bottom of the vehicle. Alternatively, the pushing post 140 may be held roughly in position by structures in the vehicle interior relative to the frame (not shown). Once in position, the pushing post 140, together with the pivot base 130, extends as much as 30 inches high, which is more than sufficient to perform most frame repairs.

The clevis 139 is attached on the front side of the pushing post 140 and may be used for a variety of convenient purposes generally unrelated to the present invention.

If desired, the swivel plate 146 may be quickly pivotally attached to the pushing post 140 by inserting a pin 134 through corresponding bores 147 in the swivel plate 146 and a bore 145 in the pushing post 140, positioned between them.

The pushing fork 160 may also be quickly pivotally attached to the pushing post 140 by inserting a pin 134 through corresponding bores 162 in the pushing fork legs 161 and a bore 145 in the pushing post 140, positioned between them. Thereafter, the internal bore 165 may be pressed onto the extended end of the inner cylindrical extension element 153 of the ram 151, separated as needed by up to four pushing extensions 166.

The pivot fastener 159 is inserted between a convenient corresponding set of bores 122 in the pushing rail legs 123. The pivoting head 155 is attached in a mating fit to the outer cylindrical sleeve 152 and its scalloped closed end 156 is lodged against the pivot fastener 159, with the protrusion 148 extending toward the floor. Thus, the ram 151 may be quickly positioned between the pushing rail legs 123 and held longitudinally in place.

The holding posts 185 may be quickly attached to their corresponding sliding posts 181 by inserting a pair of pins 134 into corresponding bores 184 in the vertical holding base 183 of the sliding post 181 and into bores 187 in the holding post 185 positioned between them.

The chain 191 is attached using the top clip 194 to the top clip bore 189 using bolt assemblies 196, 197 and to the thick washer 176 at the floor rail 110 away from where the holding force is to be applied, using the bottom clip 192. Each holding post 185 is positioned such that the vehicle frame rests on the ledge 186 in the holding post 185. Once the holding post 185 is in the proper position, the chain tensioner 198 is activated to take up all the slack in the chain 191 and the holding rail 171 is fixed in place.

At this point, the set-up phase of the repair operation is complete and the repair operation may commence. A repair is effected by pushing from inside against a deformity in the frame with the pushing post 140, while holding the rest of the frame steady from the outside using the two holding posts 185.

The foregoing embodiment presumes that the frame straightening operation is to be performed on a side wall of the frame. Frequently, however, a repair must be effected on the front or back end of the frame. Because front and back end collisions often skew the frame out of square, such repairs are often referred to as a "diamond" repair.

Figure 6:
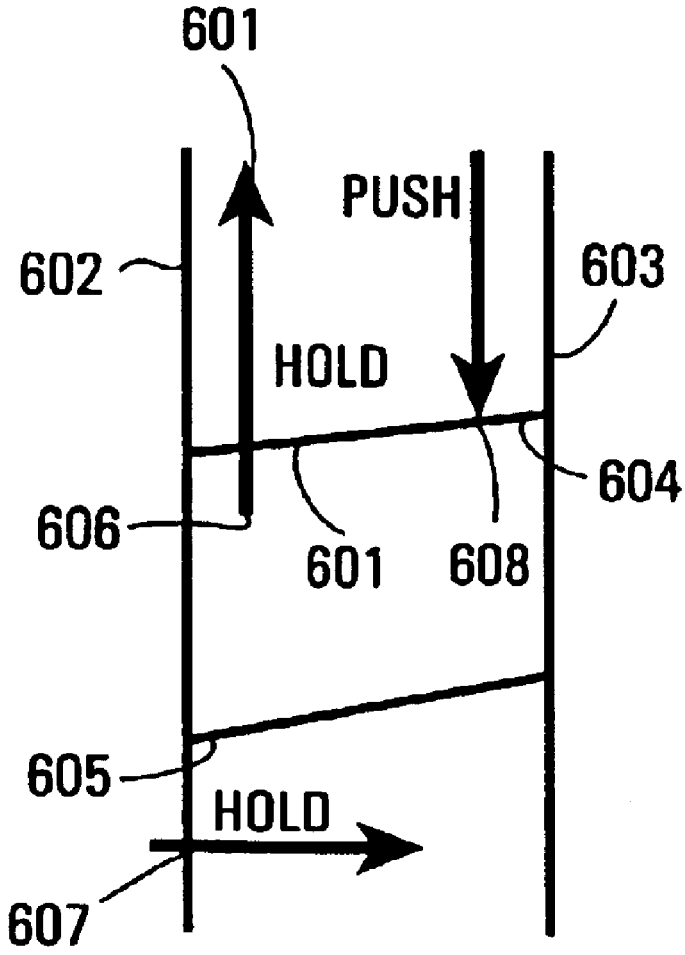
FIG. 6 is a diagrammatic representation of the forces applied in the embodiment of FIG. 5.

In FIG. 6, the structural members of a frame that sustained damage requiring a diamond repair are shown. The collision occurred at point 601, resulting in an acute angle between the closest frame rail 602 and the adjoining frame cross-members 604, 605.

In order to effect such repairs, it is necessary to apply force at multiple points. Pressure may be applied to cross-member 604 at a point proximate 608 to the distal frame rail 603, while holding pressure 606 is applied at cross-member 604 proximate to the original collision point. Further holding pressure 607 is applied transversely at frame rail 601, preferably at a point separated by a cross-member 605.

Figure 5:
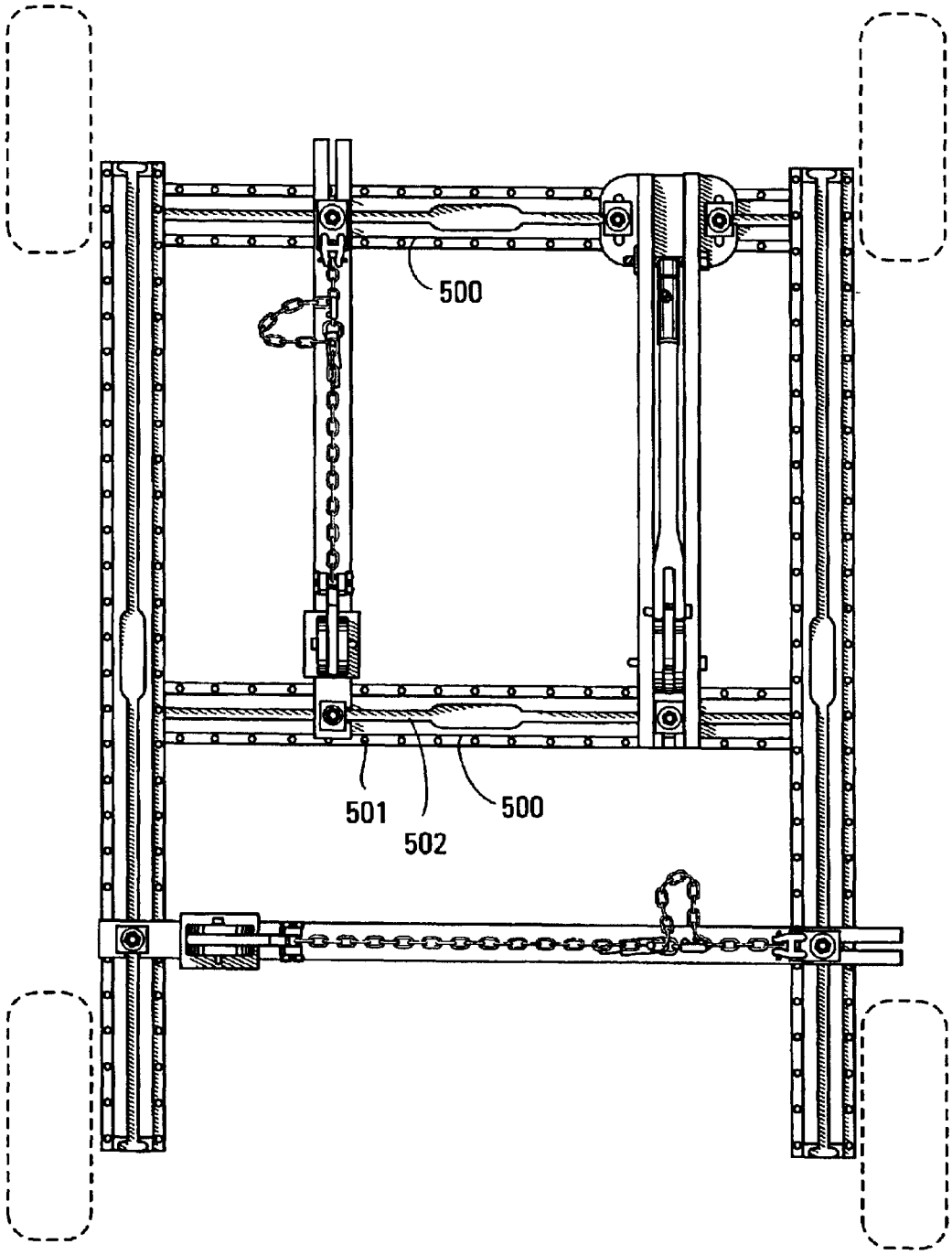
FIG. 5 is a plan view of a second embodiment of the present invention.

The present invention may be configured to effect diamond repairs, through a slight modification to the apparatus shown in FIG. 1, as may be seen in FIG. 5.

The modification consists of the addition of two identical diamond rails 500. Each diamond rail is comparable to that of the floor rails 110 except for length and lie on the floor connecting them.

Each diamond rail 500 is bolted to the floor of the repair facility through a series of bores 501. The channel 502 in the diamond rail 500 is substantially identical to the channel 115 in the floor rail.

The diamond rails 500 may be cast or extruded out of aluminum. Alternatively, the diamond rails 500 may be composed out of separate pieces of similar material welded or otherwise fastened together.

One diamond rail 500 is attached to the floor proximate to one end of the floor rails 110, which corresponds to the end of the vehicle frame to be repaired. The other diamond rail 500 is attached to the floor 110 at a distance from the first diamond rail 500, corresponding to the separation between the floor rails 110, or six feet.

Once so attached, in effect, a system of channels 502 will have been created in the direction normal to the channels 115, to accept the pushing rail 121 and one or both of the holding rails 171.

The pushing rail 121 may thereupon be attached to the diamond rails 500 in a manner similar to its attachment to the floor rails 110 in the previous embodiment. It is oriented so that the flange end 126 lies on the outer diamond rail 500, or proximate to the bumper, while the notch end 127 lies on the inner diamond rail 500, or proximate to the transmission.

A holding rail 171 may also be attached to the diamond rails 500 in a manner similar to its attachment to the floor rails 110 in the previous embodiment. It is oriented so that the holding post 185 is proximate to the inner diamond rail 500.

The other holding rail 171 is attached to the floor rails 110, positioned transversely to keep the exterior frame from swaying. Generally, the point of contact is on the side away from the area to be repaired and separated from the area to be repaired by at least one frame cross-member.

In operation, the vehicle is driven or backed into position relative to the floor rails, with the repair site proximate to the diamond rails 500.

Because the wheels lie beside the floor rails 110, the bolts 116 may be easily slid into the channel 115 of the floor rails 110 or into the channel 502 of the diamond rails 500 as the case may be, at one of the wider openings and advanced along the track formed by the opening in the channel 115 or 502 until they reach the desired position.

At this point, the pushing rail 121 and holding rails 171 may be moved into position from the side or end of the vehicle, as previously described and the pivot base 130, pushing post 140, sliding post 181 and holding posts 185 installed in position as previously described. The shorter of the two sliding posts 181 should be installed on the holding rail 171 that is secured to the diamond rails 500, because this will be located beneath the vehicle. The ram assembly 150 and the chain 191 may thereafter be installed and adjusted and tensioned.

At this point, the set-up phase of the repair operation is complete and the repair operation may commence. As before, a repair is effected by pushing from inside against the frame cross-member until the acute angle formed by the frame rail and cross-member is extended to a right angle, while holding the frame steady using the two holding posts 185.

The diamond rails 500 may also be used to effect non-diamond frame repairs on the front or back end of the vehicle, such as for motor mounts or cross-members. In such a case, a deformity in the frame is repaired by applying pressure from within using the pushing assembly 120, while holding the frame steady using the two holding assemblies 170, all of which are mounted on the diamond rails 500.

Figure 7:
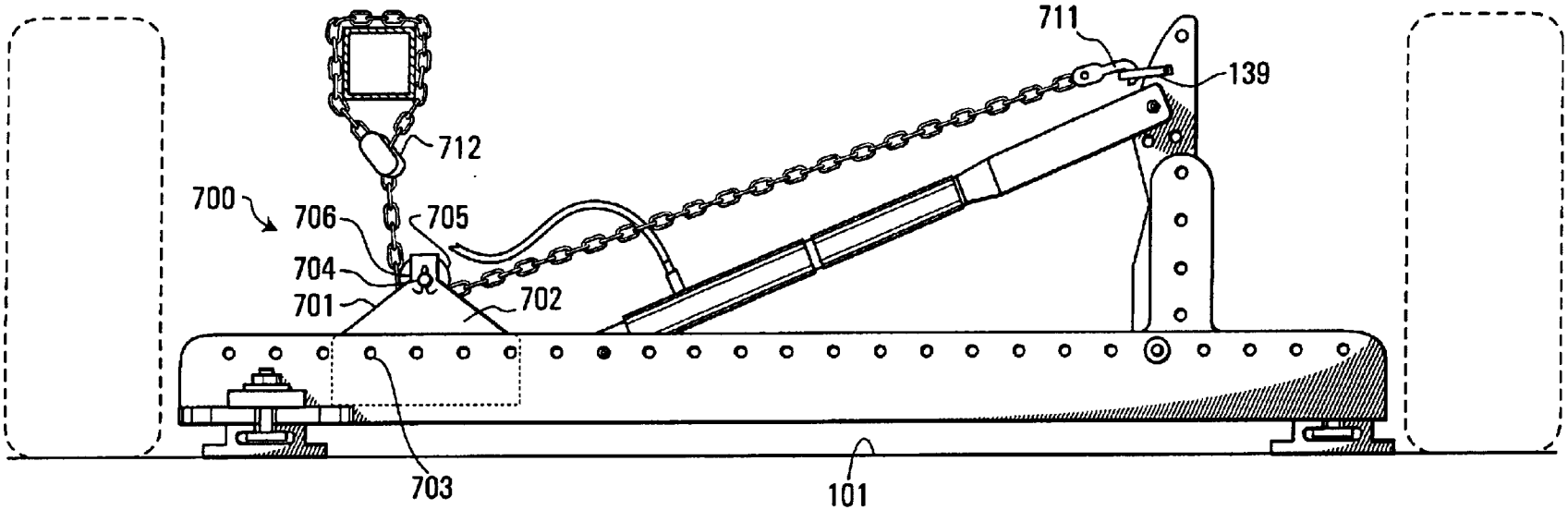
FIG. 7 is a sectional view of a third embodiment of the present invention.

Turning to FIG. 7, pull down operations may be effected using a third embodiment of the inventive apparatus. Such operations are required when the front or rear bumper of the vehicle have been driven upward or downward relative to the frame as a result of a collision with a low object such as a crash barrier. While such operations are typically repaired using frame-pulling equipment, such equipment may be obviated by implementation of this third embodiment.

This embodiment of the present invention requires a pulley assembly 700 and a pulling chain 710 in addition to the apparatus of either the first or second embodiments.

The pulley assembly 700 comprises a pulley base 701 and a pulley wheel 705 attached to the base 701 by a pulley fastener 709. The pulley base 701 may be cast or extruded out of steel. Alternatively, it may be composed of separate pieces of similar material welded or otherwise fastened together.

The pulley base 701 has a U-shaped cross-section with triangular legs 702. The legs 702 have a series of horizontal bores 703 extending across their width near the base of the pulley base 701. The size of the bores 703 and their separation correspond to that of the bores 122 on the pushing rail legs 123. Thus, pins 134 may be inserted through a bore 122 on one leg 123 of the pushing rail 121, through the bores 703 on each pulley base leg 702 and through the corresponding bore 122 on the other leg 123 of the pushing rail 121. When two pins 134 are passed through pairs of bores 703 in the pulley base 701, the pulley base 701 is fixed in position along the pushing rail 121.

The pulley base legs 702 also have a single bore 704 extending through them proximate to their apex. The apex of the pulley base legs 702 may be interconnected at their apex by a narrow bar.

The pulley wheel 705 is a cylindrical wheel with a bore 706 passing through its axis. The wheel 705 has a sufficient diameter to permit the pulling chain 710 to wrap around it without kinking, but is small enough to fit within the pulley base 701. The pulley wheel 705 is attached to the pulley base 701 between the pulley base legs 702 in free rotational engagement by passing the pulley fastener 709 through the bore 703 in the pulley base legs and the bore 806 in the pulley wheel 705.

The pulling chain 710 is approximately six feet long, may be standard steel or iron ⅜" chain, grade 8, and has a rated strength of 25,000 pounds. One end terminates in a hook assembly 711. The other end may terminate in a clip 712 with which it can fasten about itself. Optionally, the clip 712 may be replaced by a second hook.

In operation, the vehicle is driven or backed into position relative to the floor rails 110. In many situations, the vehicle is positioned in front of the floor rails 110, such that the repair site extends slightly over them.

Whether the wheels lie beside the floor rails 110 or away from them entirely, the bolts 116 may be easily slid into the channel 115 of the floor rails 110 or into the channel 502 of the diamond rails 500 as the case may be, at one of the wider openings and advanced along the track formed by the opening in the channel 115,502 until they reach the desired position.

At this point, the pushing rail 121 may be moved into position and in the fashion described previously and the pivot base 130 and pushing post 140 installed in position as previously described. In most situations, the pushing assembly 120 is installed in front, beside or behind the vehicle, not under it. The ram assembly 150 and the chain 191 may thereafter be installed and adjusted and tensioned.

The pulling chain 710 is attached at its hook end 711 to the clevis 139 attached to the shaped end 144 of the pushing post 140. The other end of the pulling chain 710 is fed under the pulley wheel 705 and between the pulley base legs 702 and then upward and wrapped around the frame to be repaired. The clip 712 may be used to lock the pulling chain 710 in position and at the proper length.

Finally, a jack stand (not shown) is positioned under the vehicle frame proximate to the point at which the pulling chain is attached to the frame. A single jack stand will suffice where the frame has been bent upward. In such a case, the jack stand should be positioned proximate to an undamaged portion of the frame. Where the frame has been bent downward, a repair may be effected by using two jack stands, one on either side of the bend in the frame.

At this point, the set-up phase of the repair operation is complete and the repair operation may commence. Here, however, a repair is effected by pushing the pushing post forward, causing the pulling chain 710 to apply downward tension on the deformed frame. The tension cannot be relieved by the entire frame moving downward because it is fixed in place vertically by the jack stand(s). Thus, the frame will be forced downward.

Figure 8:
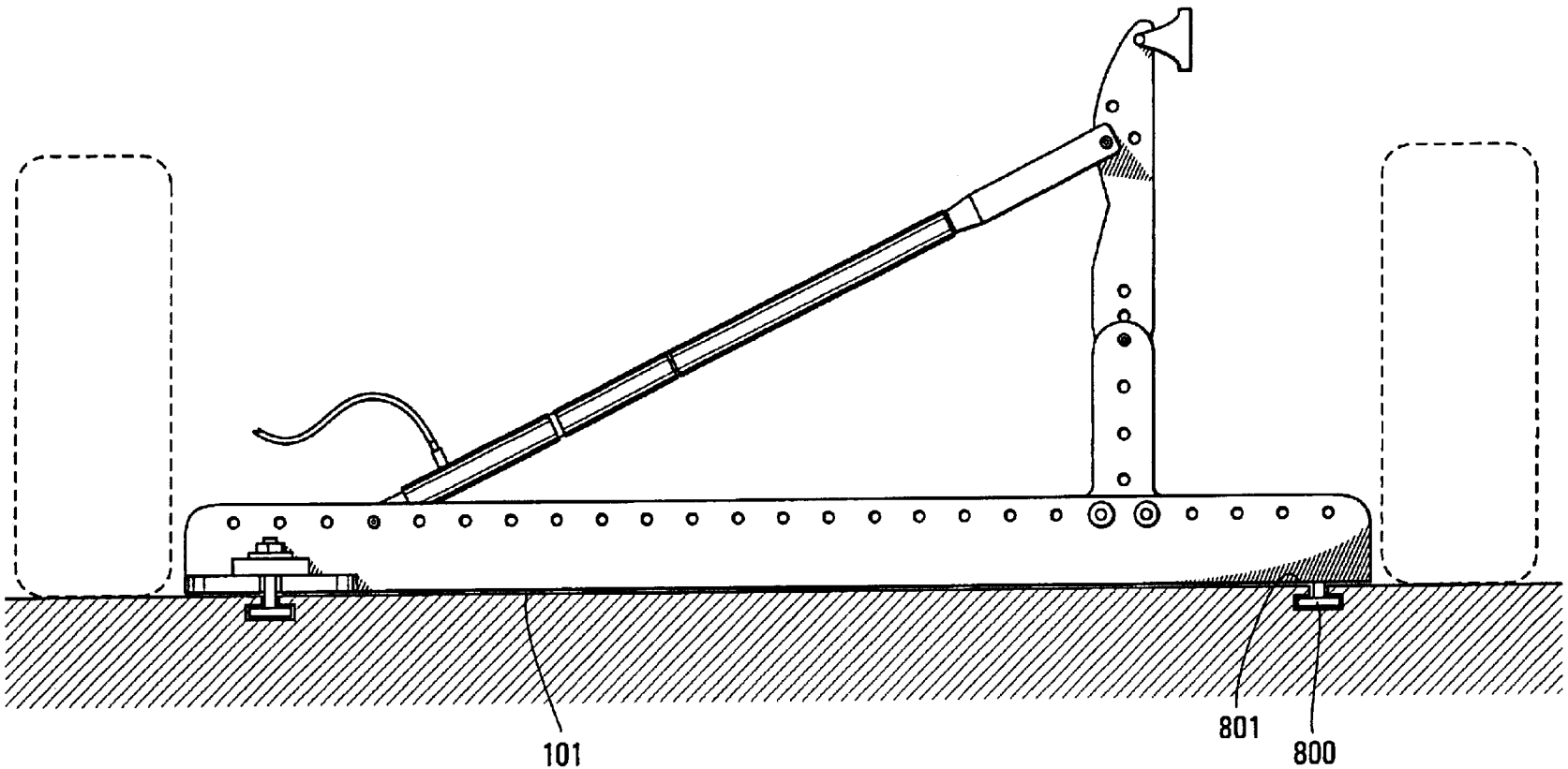
FIG. 8 is an end view of a fourth embodiment of the present invention.

In a fourth embodiment of the present invention, shown in FIG. 8, the floor rails 800 need not be bolted to the floor of the repair facility, but may be embedded within or form part of the floor itself, such that the top 801 of the floor rail 110 is flush with or extends slightly beyond the floor surface. Thus, the bores 112 and bolts are obviated, and the vehicle may be easily driven over the rails 800 with minimal impediment.

The combination of floor rails 110, lightweight but strong pushing rails 121 and holding rails 171 and two piece vertical posts for pushing and holding actions permits the frame pushing repair process to be effected directly over the floor of a repair facility, without the need for elevating the vehicle on rails or for excavating a pit below the floor level in order to provide sufficient ground clearance to permit installation of the posts.

With the use of sliding channels in the floor rails, pins for easy insertion and removal, lightweight and small pivoting components, the set-up phase need no longer dominate the repair process, with a consequent increase in throughput and reduced cost to the repair facility and ultimately the consumer.

Figure 9:
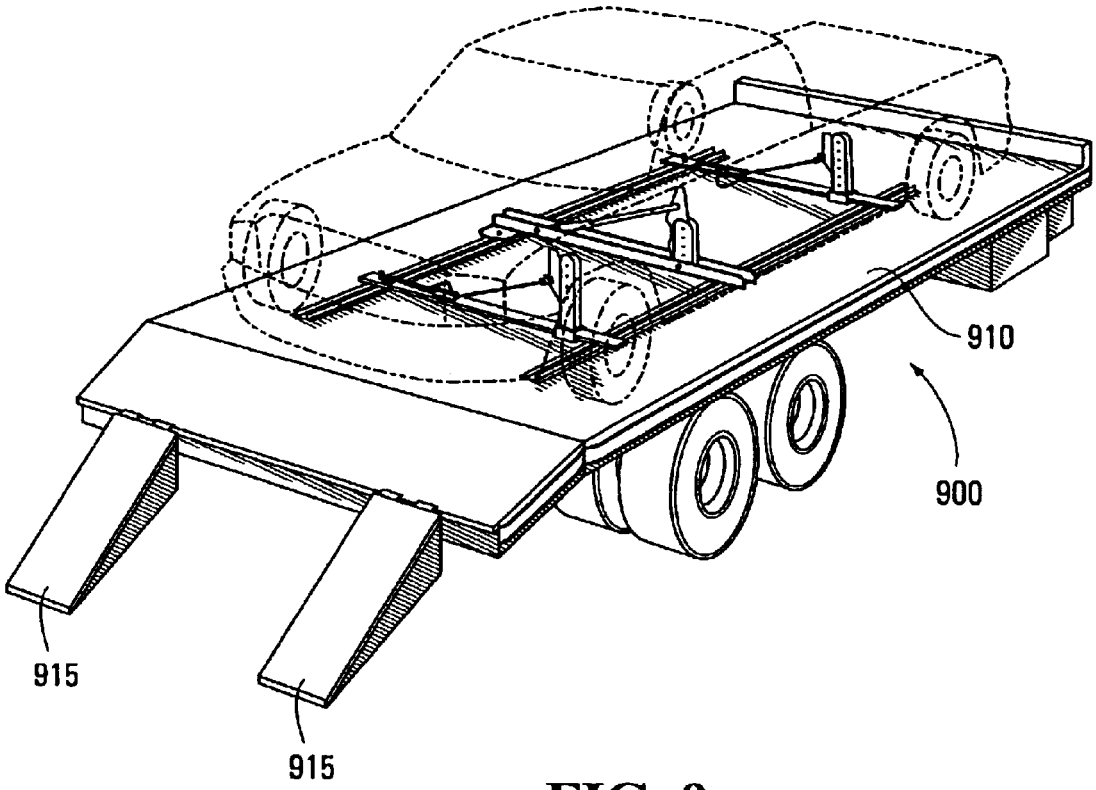
FIG. 9 is a perspective view of a fifth embodiment of the present invention.

These features permit other innovations to be implemented. For instance, the floor rails 110 may be mounted on the bed 910 of a small towed platform 900, as shown in FIG. 9, to provide a portable repair facility. Thus the platform 900 may be transported to the vehicle to be repaired and the vehicle repaired on-site, only requiring that the vehicle be pushed or driven up ramps 915 onto the platform bed. If the platform 900 has no walls, or sufficient clearance between the rails 110 and the walls (not shown), there would be no impediment to inserting the pushing rail 121 and holding rails 171 under the vehicle from the side or end as required. Alternatively, the walls (not shown) may be configured to be removeable or to fold down in order to provide the required access.

It will be apparent to those skilled in this art that various modifications and variations may be made to the embodiments disclosed herein, consistent with the present invention, without departing from the spirit and scope of the present invention.

Other embodiments consistent with the present invention will become apparent from consideration of the specification and the practice of the invention disclosed therein.

Accordingly, the specification and the embodiments are to be considered exemplary only, with a true scope and spirit of the invention being disclosed by the following claims.

I claim:

1. A vehicle frame straightening apparatus comprising a substantially upright post for engagement with a floor on which the vehicle rests, and adapted to apply pressure between the floor and outward on a deformity in the vehicle frame from wider the vehicle, wherein the post is positionable against the deformity from beside the vehicle without requiring an increase in the vehicle's ground clearance;

wherein the post engages the floor by a series of rails fixed to the floor and adapted to attach to a transverse tail mounted transversely thereon to which the post is adapted to be attached; and wherein the transverse rail comprises a pushing rail adapted to hold the post and mountable to the series of rails fixed to the floor and positionable thereon from the side of the vehicle under repair while the vehicle extends over them.

2. The apparatus of claim 1 wherein the post comprises a substantially upright lower portion and an upper portion adapted to be attached thereto in order to extend its height.

3. The apparatus of claim 2 wherein the lower portion of the post does not exceed the ground clearance of the vehicle.

4. the apparatus of claim 2 wherein the upper portion of the post is adapted to be pivotally attached to the lower portion.

5. The apparatus of claim 2 wherein the overall height of the post is adjustable.

6. The apparatus of claim 1 wherein the pushing rail is positionable at any point relative to the rails fixed to the floor and quickly and releasably fixed in position at that point.

7. The apparatus of claim 6 wherein the pushing rail is slidably engaged with the rails fixed to the floor by a series of bolt assemblies engaging channels is in the rails fixed to the floor and fixed in position by tightening the bolt assemblies.

8. The apparatus of claim 6 wherein the post is mountable to the pushing rail and positionable thereon from the side of the vehicle under repair while the vehicle extends over it.

9. The apparatus of claim 6 wherein the post is positionable at one of a plurality of positions along the pushing rail and quickly and releasably fixed at that position.

10. The apparatus of claim 9 wherein the post is fixed into position using pins.

11. The apparatus of claim 1 wherein the rails fixed to the floor are embedded therein.

12. The apparatus of claim 1 wherein the rails fixed to the floor form pail thereof.

13. The apparatus of claim 1 wherein a first pair of the rails fixed to the floor are parallel and oriented in one direction.

14. The apparatus of claim 13 wherein the rails fixed to the floor are separated by a distance of six feet.

15. The apparatus of claim 13 wherein the rails fixed to the floor further comprise a second pair of rails oriented perpendicular to the first pair and separated by a distance substantially equal to the distant separating the first pair.

16. The apparatus of claim 2 wherein pressure is applied on the deformity by a ram assembly engaging the upper portion of the post and the floor.

17. The apparatus of claim 16 wherein the ram assembly is adapted to be assembled from the side of the vehicle under repair.

18. The apparatus of claim 1 wherein the vehicle under repair is held in position while pressure is being applied by at least one holding assembly.

19. The apparatus of claim 1 wherein one of the transverse rails is adapted to accept an assembly for exerting substantially vertical tension at a point on the vehicle under repair.

20. The apparatus of claim 19 wherein the assembly comprises a chain attached to the point on the vehicle under repair and looped through a pulley mounted on the transverse rail, whereby lateral motion of the chain away from the pulley exerts substantially vertical tension on the vehicle under repair.

21. The apparatus of claim 1 wherein the floor comprises the floor of a mobile platform transportable to a remote location in order to effect vehicle repairs at that location.

22. A vehicle frame straightening apparatus comprising:

a substantially upright post for engagement with a floor on which the vehicle rests, and adapted to apply pressure between the floor and outward on a deformity in the vehicle frame from under the vehicle, wherein the post is positionable against the deformity from beside the vehicle without requiring an increase in the vehicle's ground clearance; and at least one holding assembly for holding the vehicle under repair in position while pressure is applied by the post, wherein the holding assembly is comprised of a holding post assembly and a holding rail;

wherein the holding assembly is adapted to engage the floor by a series of rails fixed to the floor and adapted to attach to the holding rail mounted transversely thereon to which the holding post assembly is adapted to be attached.

23. The apparatus of claim 22 wherein the holding post assembly is adapted to engage the frame along the frame's exterior.

24. The apparatus of claim 23 wherein the holding post assembly comprises a substantially upright lower portion and an upper portion adapted to be attached thereto in order to extend its height.

25. The apparatus of claim 24 wherein the lower portion of the holding post assembly does not exceed the ground clearance of the vehicle.

26. The apparatus of claim 24 wherein the overall height of the holding post assembly is adjustable.

27. The apparatus of claim 22 wherein the holding rail is adapted to hold the holding post assembly and is mounted to the rails fixed to the floor and positionable thereon from the side of the vehicle under repair while the vehicle extends over them.

28. The apparatus of claim 22 wherein the holding rail is positionable at any point relative to the rails fixed to the floor and quickly and releasably fixed in position at that point.

29. The apparatus of claim 28 wherein the holding rail is slidably engaged with the rails fixed to the floor by a series of bolt assemblies engaging channels in the rails fixed to the floor and fixed in position by tightening the bolt assemblies.

30. The apparatus of claim 28 wherein the holding post assembly is mountable to the holding rail and positionable thereon from the side of the vehicle under repair while the vehicle extends over it.

31. The apparatus of claim 28 wherein the holding post assembly is positionable at one of a plurality of positions along the holding rail and quickly and releasably fixed at that position.

32. The apparatus of claim 31 wherein the holding post assembly is fixed into position by applying tension to the holding post assembly to fix it in position against the vehicle under repair.

33. The apparatus of claim 32 wherein the tension is applied by chains interconnecting the holding post assembly and a rail.

34. A vehicle frame straightening apparatus comprising a substantially upright post adapted to engage a first rail mounted transversely to a series of rails fixed to a floor on which the vehicle rests, and adapted to apply pressure between the floor and outward on a deformity in the frame from under the vehicle by a ram engaged therebetween, wherein the vehicle is held in position by at least one holding assembly adapted to engage the vehicle frame from the outside and to engage to a second rail mounted transversely to the rails fixed to the floor, and wherein the post comprises a substantially uptight lower portion and an upper portion adapted to be pivotally attached thereto in order to extend its height and wherein the lower portion does not exceed the ground clearance of the vehicle, whereby the post is positionable against the deformity from beside the vehicle, without requiring an increase in the vehicle's ground clearance.

* * * * *